US005192055A

United States Patent [19]

Griggs et al.

[11] Patent Number: 5,192,055

[45] Date of Patent: Mar. 9, 1993

[54] POST BRACE ASSEMBLY

[76] Inventors: Billy A. Griggs, 43495 SE. George Rd.; Kenneth B. Weaver, 40585 SE. George Rd., both of Estacada, Oreg. 97023

[21] Appl. No.: 862,431

[22] Filed: Apr. 2, 1992

[51] Int. Cl.[5] ..... B21F 27/00

[52] U.S. Cl. ..... 256/35; 248/354.1; 256/DIG. 5

[58] Field of Search ..... 248/519, 524, 354.1; 256/35, 36, 47, 54, DIG. 5; 52/150, 152; 403/4

[56] References Cited

U.S. PATENT DOCUMENTS

| | | | |
|---|---|---|---|
| 429,032 | 5/1890 | Hollensbe | 256/35 X |
| 560,364 | 5/1896 | Owens | 256/35 X |
| 769,479 | 9/1904 | Hutchison | 256/35 |
| 1,981,447 | 11/1934 | Clark | 256/35 X |
| 2,690,326 | 9/1954 | Kranick | 256/35 X |
| 2,849,202 | 8/1958 | McCombs | 248/524 |
| 4,349,181 | 9/1982 | Asher | 52/152 X |
| 4,936,550 | 6/1990 | Wickham | 256/54 X |
| 5,042,780 | 8/1991 | Yearwood | 52/150 X |
| 5,061,109 | 10/1991 | Miller | 256/35 X |

FOREIGN PATENT DOCUMENTS

| | | | |
|---|---|---|---|
| 1048439 | 11/1966 | United Kingdom | 256/35 |

*Primary Examiner*—J. Franklin Foss
*Attorney, Agent, or Firm*—James D. Givnan, Jr.

[57] ABSTRACT

A brace assembly for fence and gate posts as well as corner posts is disclosed and includes upper and lower bracket assemblies for clamped engagement with a fence post. Each bracket assembly includes angular bracket members which may include diagonal flanges which serve to receive the ends of adjustable braces. Lower bracket assemblies serve to attach ground engaging members to the post. The braces are axially adjustable for attachment to the ground engaging members which may be inclined for contact with sloped terrain. A modified form of a bracket assembly includes a clamping plate with a boss through which extends a gate pintle arm to permit a fence post to serve as a gate post. A further modification of the bracket assemblies permits a steel fence post to serve as a fence corner post with braces extending downwardly and rearwardly from the corner post. Additional bracing may extend horizontally from the corner post to adjacent fence posts. A still further modified form of the present brace assembly includes a bracket assembly utilizing four angular members to permit attachment to the post of several braces each with a corresponding ground engaging member.

8 Claims, 2 Drawing Sheets

POST BRACE ASSEMBLY

BACKGROUND OF THE INVENTION

The present invention pertains generally to brace structures for clamping to posts such as fence posts.

In wide use are steel fence posts which characteristically are of T section and having a series of forwardly projecting studs spaced along their front faces. Such posts commonly include a spade or plate adjacent their lower ends and come in a range of lengths to suit various uses including use in home yards and in fields. It is the latter use that such posts are subjected to severe loads such as those resulting from cattle contacting fencing which results in bending of the steel fence posts to enable escape of stock. In the prior art are a number of efforts to brace fence posts of various types. Generally speaking such bracing attempts provide downwardly diverging supports or braces having their lower ends buried. U.S. Pat. No. 4,712,762 discloses a post structure for the temporary support of an electrical conduit to a house under construction wherein brackets are clamped to the post with bracket flanges receiving the upper end of braces which terminate downwardly in contact with a ground surface. While such an arrangement is not disclosed as supporting a fence post, the bracket structure is of some relevance in that it shows a bracket clamped to a post and used to attach the ends of multiple braces to a post. Bracing of corner fence posts is particularly a problem.

SUMMARY OF THE PRESENT INVENTION

The present invention is embodied within bracket assemblies for attachment to a post and which carry adjustable ground engaging members which brace the post regardless of sloping terrain.

The bracket assemblies include clamping components vertically spaced on the post which adjustably receive ground engaging members and supports therefore to permit positioning of the members to effect ground abutment. The supports may be adjustable to engage the ground engaging members and support the latter throughout a range of inclined positions. The post attached clamping members additionally each include rearwardly directed flanges to receive, if desired, additional pairs of braces or supports and ground engageable members to support the post against loads encountered when used as a corner post or where loads are imparted against the forward face of the post. Still further provided on each clamping member are rearwardly directed parallel flanges which serve in a dual manner to clamp the bracket assembly to the post as well as receive a rearwardly directed brace and ground engaging members attached thereto.

Important objectives include the provision of a post brace assembly including bracket assemblies for spaced attachment to a post which serve to attach multiple ground engaging members to the post as well as multiple braces therefore both laterally and rearwardly of the post to permit the post to support loads far beyond those of an unbraced post; the provision of a post brace assembly for a fence post particularly suited for use on farm or ranch land where the terrain is often uneven which heretofore required considerable time consuming efforts to provide bracing suited for each and every ground peculiarity encountered; the provision of a brace assembly which is suited for bracing studded steel fence posts through a wide range of ground conditions including uneven terrain and those conditions where the soil is of low load bearing capacity as the present brace assembly provides ground engaging members of considerable surface area; the provision of a brace assembly for a studded steel fence post utilizing low cost components yet adding great strength to the post for bearing loads from several directions; the provision of a brace assembly which may be readily modified to constitute part of a gate supporting structure to permit bracing of a steel fence post to the extent it may be utilized as a gate post.

BRIEF DESCRIPTION OF THE DRAWINGS

In the accompanying drawings.

DETAILED DESCRIPTION OF THE PREFERRED EMBODIMENTS

Figure 1:
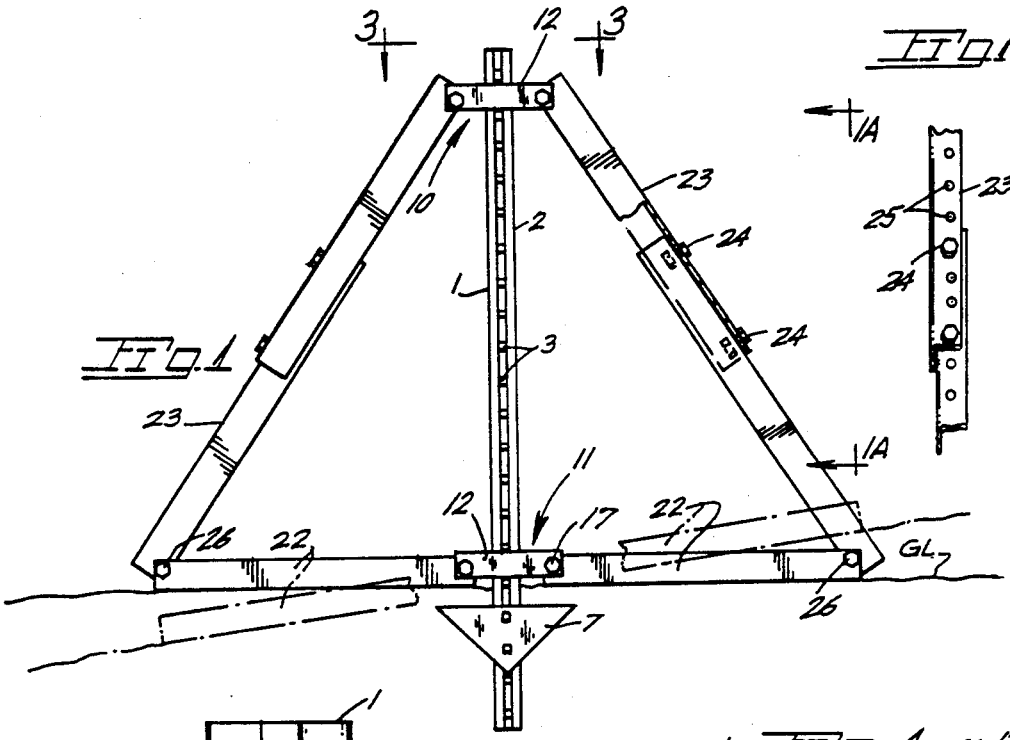
FIG. 1 is a front elevational view of a fence post and the present brace assembly attached thereto.
Figure 1A:
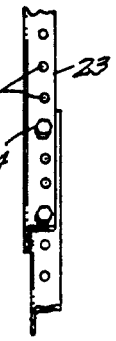
FIG. 1A is a vertical elevational view taken along line 1A—1A of FIG. 1.
Figure 2:
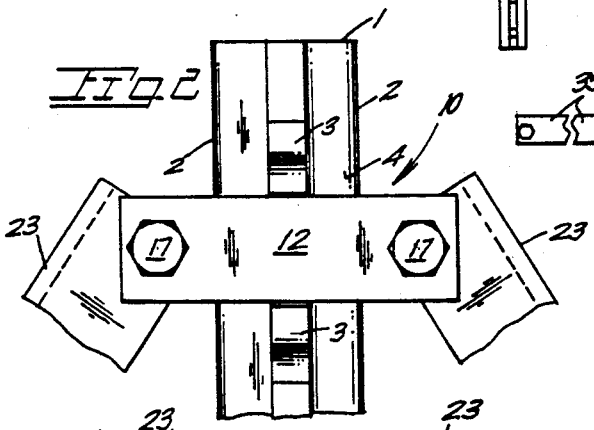
FIG. 2 is an enlarged fragmentary view of the upper end of the fence post shown in FIG. 1 along with the bracket assembly in place thereon.

With continuing attention to the drawings wherein applied reference numerals indicate parts similarly hereinafter identified, the reference numeral 1 indicates a post of the type commonly found in use for a wide range of home and farm purposes. Said posts are of generally T shape in section with wings at 2 and vertically spaced apart studs 3 along their frontal face as at 4. A rearwardly directed post rib is at 6. A blade or plate 7 is secured to post frontal face 4 with the plate apertured to permit passage of multiple studs 3. The foregoing is intended to be a general description of a studded T fence post. The post as above described is dependent on the buried lower end segment and blade 7 thereon to provide resistance to horizontally directed loads.

With attention now to the present invention, upper and lower bracket assemblies are indicated generally at 10 and 11 with the following description of one bracket assembly applicable to both. A clamping plate 12 is provided for placement laterally across the frontal face of 4 of the post and is of a width to permit disposition between adjacent studs 3 on the front of the post. Angular bracket members at 13 each include right angularly disposed rearwardly directed flanges 14 extending or projecting rearwardly of the post for reception of a fastener assembly 15. The forward angular flanges at 16 are apertured to receive fastener assemblies 17 which serve to clamp plate 12 of the bracket assembly to the front of the post. Outwardly and rearwardly diverging diagonal flanges 20 are preferably included on each of the angular members for attachment of later described rearwardly directed braces. Parallel flanges 14 of the two angular brackets and fastener 15 may also be used to additionally attach a rearwardly extending brace of the type later described.

Attachable to lower bracket assembly 11 are elongate ground engaging members at 22 which may project laterally or rearwardly from the fence post for contact with the ground.

Figure 3:
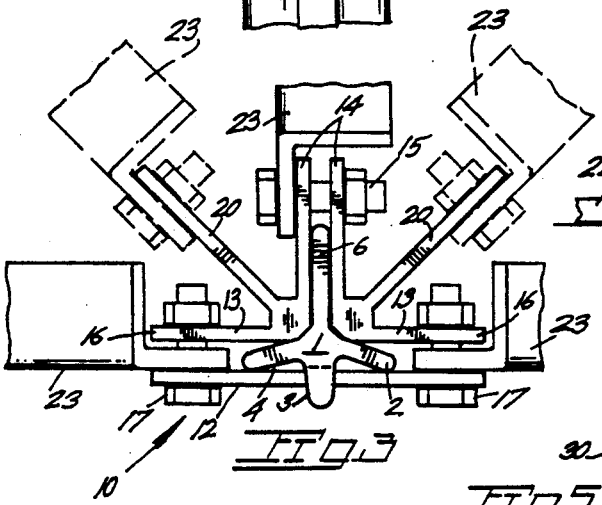
FIG. 3 is a plan view taken along line 3—3 of FIG. 1.

Supports or braces at 23 for the ground engaging members are preferably segmented with fastener assemblies at 24 joining the segments in an adjustable manner by reason of the segments being provided with spaced apart apertures 25 which may be registered with one another for fastener reception. Accordingly elongate ground engaging members 22 may be swung upwardly or downwardly about fasteners 17 for ground contact with the brace 23 being shortened or lengthened and secured in place by fasteners 24. Coupling the distal ends of the ground engaging members and braces is by fasteners at 26. The ground engaging members as well as the braces may be constructed from angle iron and punched or otherwise apertured for fastener reception. As shown in FIG. 3, a multitude of braces and elongate ground engaging members (shown as five) may be utilized.

Figure 4:
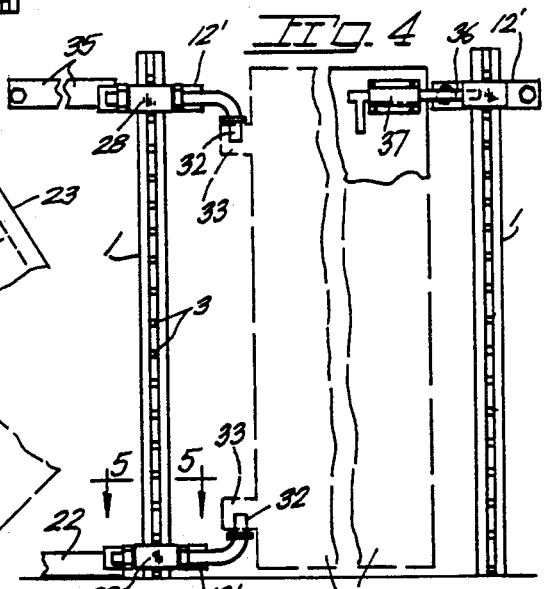
FIG. 4 is a front elevational view of a gate structure wherein the present brace assembly serves as a gate support.
Figure 5:
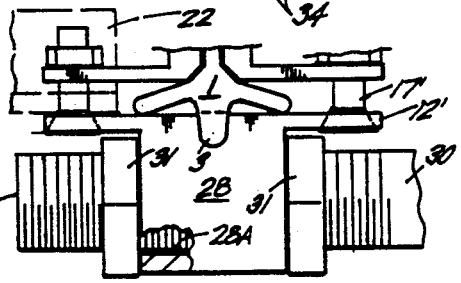
FIG. 5 is a horizontal sectional view taken downwardly along line 5—5 of FIG. 4.

With attention to FIGS. 4 and 5, the present bracket assembly may be modified to permit a fence post to serve as a gate post. The modification includes the provision of a boss 28 on a modified clamping plate 12' with the boss having a transversely extending bore 28A in which is received a pintle arm 30. Nut elements 31 on a threaded segment of the pintle arm adjustably mount the arm for horizontal positioning of an upright pintle end 32 received in a socket 33 carried by a gate 34. Such pintles have downwardly and upwardly orientated ends at 32 to confine a gate against vertical movement. Such a modification of a bracket assembly permits conventional studded steel posts to be used as gate posts by reason of the bracket members additionally providing for attachment of braces as at 35 which extends outwardly for engagement with the first described bracket assemblies on the next fence post. The modified bracket assembly may also serve as a gate lock component by providing a receptacle for a bolt 36 of a bolt slidably carried in a gate mounted sleeve 37.

Figure 6:
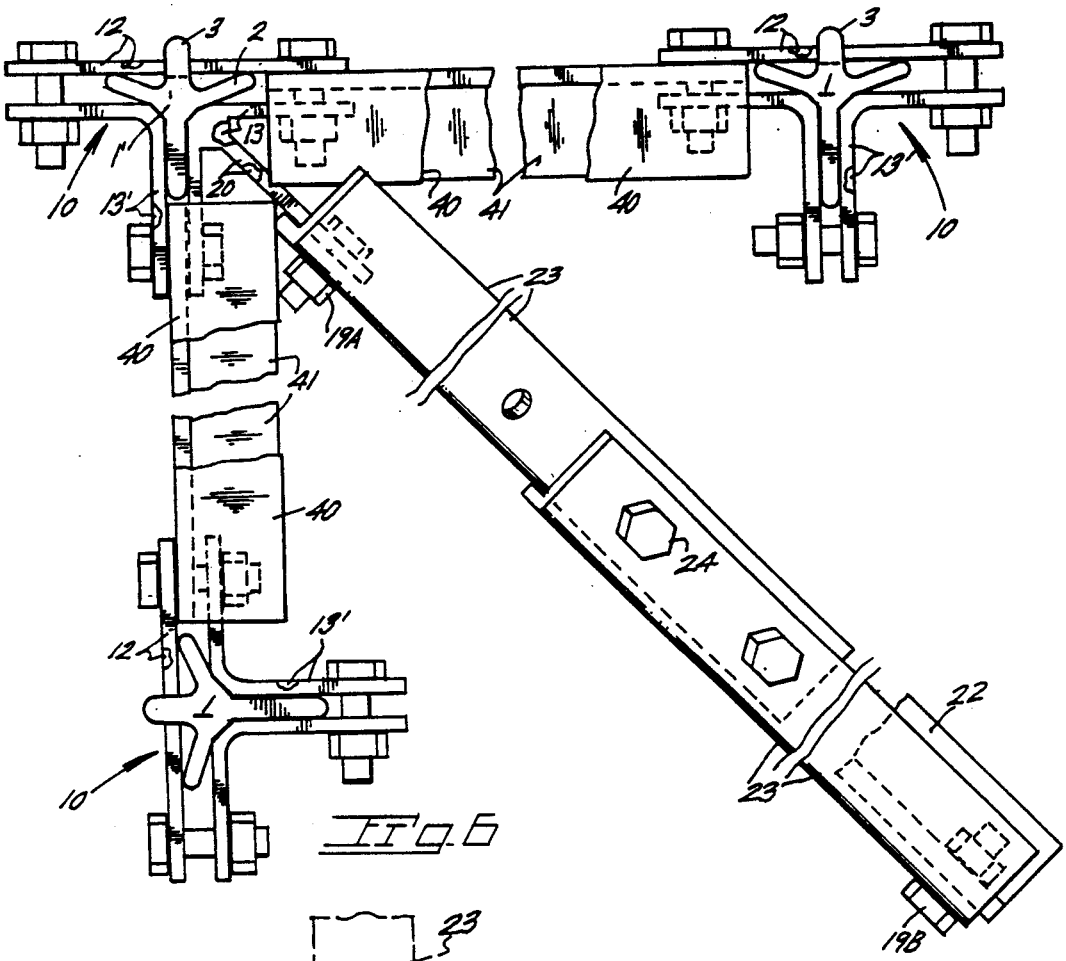
FIG. 6 is a top plan sectional view of a corner fence post braced by upper and lower bracket assemblies with braces and ground engaging members.

In FIG. 6 a top plan view of a corner post brace assembly is shown which permits a studded metal post at 1' of T section, to serve as a corner post. An upper bracket assembly 10 includes a diagonal flange 20 as would the lower bracket assembly as earlier described. Inclined brace 23 is apertured at its upper end to permit flange attachment by a fastener 19A with the lowermost end of the brace coupled by a fastener 19B to a ground engaging member 22 the remaining or inner end of which terminates in fastened attachment to a diagonal flange 20 of a lower bracket assembly 11 of the type described earlier. Brace 23 as earlier described is preferably segmented with the segments apertured to receive fasteners 24 to permit lengthwise adjustment of the brace to accommodate the inclination, if necessary, of ground engaging member 22. If deemed necessary, inclined brace 23 may be supplemented by additional braces extending in an inclined manner from upper bracket assembly 10 on corner post 1' downwardly to the lower bracket assembly on adjacent fence posts at 1. Still further, upper and lower horizontal braces at 40 and 41 may brace the corner post 1' by the braces extending horizontally intermediate pairs upper and lower bracket assemblies thereon. The lowermost horizontal braces 41 would be inverted to provide maximum surface contact with the ground. Additionally, the horizontal braces 40–41 are preferably segmented.

Figure 7:
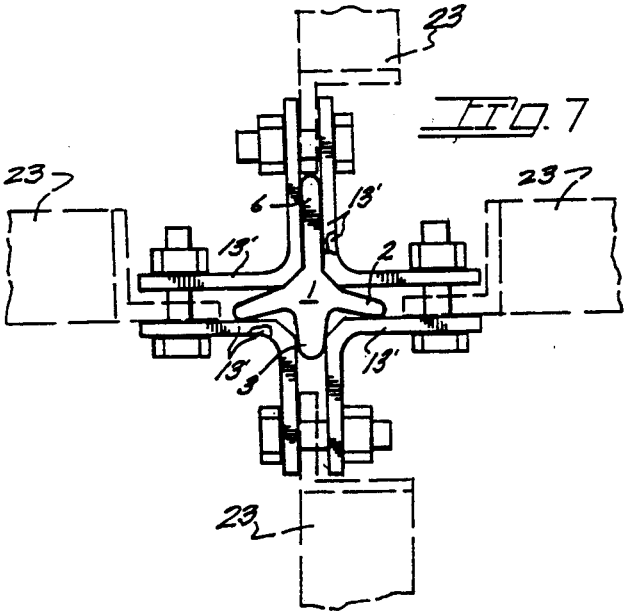
FIG. 7 is a top plan view of a fence post fitted with upper and lower bracket assemblies and four braces.

The upper and lower bracket assemblies may vary, as earlier noted, in that the diagonal flange 20 may be dispensed with in some angular bracket members such as those at 13' in FIG. 6. Upper and lower bracket assemblies may, as shown in FIG. 7, utilize four angular bracket members 13' and dispense with a flat clamping plate 12. Accordingly forwardly and rearwardly projecting braces at 23 may be coupled to the post 1 with the lower extremities of the braces attached to forwardly and rearwardly projecting ground engaging members to brace a post against fore and aft forces with laterally applied forces borne by laterally extending braces 23 and the attached ground engaging members coupled thereto.

While we have shown but a few embodiments of the invention, it will be apparent to those skilled in the art that the invention may be embodied still otherwise without departing from the spirit and scope of the invention.

Having thus described the invention, what is desired to be secured by a Letter Patent is:

1. A brace assembly for attachment to a fence post, said assembly comprising, an upper bracket assembly and a lower bracket assembly for clamped attachment to said post in a spaced apart manner, elongate ground engageable members attached at one of their ends to said lower bracket assembly, elongate braces each attached at one of their ends to said upper bracket assembly, and coupling means attaching the remaining end of each of said braces to one each of said ground engaging members, and wherein said upper bracket assembly and said lower bracket assembly each comprise a main clamping plate, angular clamping members, fastener means engageable with said main clamping plate and said angular clamping members, additional fastener means engageable solely with said angular clamping members.

2. The brace assembly claimed in claim 1 wherein said braces each include segments, fasteners joining said segments in an axially adjustable manner to permit attachment of the braces to the ground engageable members through a range of inclined positions of said members.

3. The brace assembly claimed in claim 1 wherein said angular clamping members each include a diagonal flange.

4. A brace assembly for bracing a steel fence post to permit same to serve as a gate supporting post, said brace assembly comprising, an upper bracket assembly and a lower bracket assembly for vertically spaced attachment to a fence post and each assembly including a boss, a pintle arm adjustably carried in said boss on which a gate may be hung, and an elongate brace coupled at one end to said upper bracket assembly, and an elongate ground engaging member carried by said lower bracket assembly.

5. The brace assembly claimed in claim 4 wherein said brace is adapted at its remaining end for attachment to an adjacent fence post.

6. A brace assembly for bracing a fence post, said assembly comprising, an upper bracket assembly and a lower bracket assembly, each said assembly including a clamping plate and fasteners for clamping the bracket assembly to the post and an apertured clamp member receiving said fasteners, an elongate ground engageable member attached at one of its ends to the lower bracket assembly, an elongate brace attached at one end to the upper bracket assembly and at its remaining end to said ground engageable member, and wherein said apertured clamp member including angularly orientated surfaces some of which project rearwardly from a fence post equipped with said upper bracket assembly and said lower bracket assembly, said elongate ground engaging member and said elongate brace engageable with certain of said surfaces to support the post against rearward displacement.

7. The brace assembly claimed in claim 6 wherein said elongate brace is segmented and includes fastener elements joining the brace segments to provide a brace of adjustable length, said ground engageable member swingably attached to the lower bracket assembly to permit contact of the elongate member with an inclined ground surface, fastener means coupling said brace to said ground engageable member.

8. A brace assembly for attachment to a fence post, said assembly comprising, a clamping plate for placement laterally across, an apertured clamp member for engagement with said post and having multiple flanges including perpendicular flanges and a diagonal flange inclined to and intermediate said perpendicular flanges, fastener means engageable with said clamping plate and said apertured clamp member for urging same into post engagement, an elongate brace attachable at one of its ends to one of said flanges, said ground engaging member a ground engageable member, means for attaching said ground engaging member to said post, means coupling a remaining end of said brace to said ground engageable member.

* * * * *